US006454619B1

(12) United States Patent
Funami et al.

(10) Patent No.: US 6,454,619 B1
(45) Date of Patent: Sep. 24, 2002

(54) TILT DEVICE FOR MARINE PROPULSION UNIT

(75) Inventors: Yasuo Funami, Saitama (JP); Kunio Banba, Saitama (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/693,594

(22) Filed: Oct. 20, 2000

(30) Foreign Application Priority Data

Jan. 28, 2000 (JP) ..... 2000-020889

(51) Int. Cl.[7] ..... B63H 20/08
(52) U.S. Cl. ..... 440/61
(58) Field of Search ..... 440/61, 62, 63

(56) References Cited

U.S. PATENT DOCUMENTS 3,885,517 A * 5/1975 Borst et al. ..... 440/61
4,165,708 A * 8/1979 Osswald ..... 440/61
4,362,514 A 12/1982 Blanchard ..... 440/61
5,067,919 A * 11/1991 Okita ..... 440/61
5,203,730 A * 4/1993 Kuragaki ..... 440/53
5,707,263 A * 1/1998 Eick et al. ..... 440/61
6,015,318 A * 1/2000 Uematsu et al. ..... 440/61
6,062,923 A * 5/2000 Kai ..... 440/61
6,146,220 A * 11/2000 Alby et al. ..... 440/61
6,183,321 B1 * 2/2001 Alby et al. ..... 440/61
6,296,535 B1 * 10/2001 Bland et al. ..... 440/61

FOREIGN PATENT DOCUMENTS

JP 736879 8/1995 ..... B63H/20/08

* cited by examiner

*Primary Examiner*—S. Joseph Morano
*Assistant Examiner*—Lars A. Olson
(74) *Attorney, Agent, or Firm*—Orum & Roth

(57) ABSTRACT

To provide a tilt device for a marine propulsion unit comprising a pair of cylinder devices to be disposed at right and left of a marine propelling unit. Also a hydraulic fluid supply/discharge unit which are separately formed from both cylinder devices, respectively and disposed between both cylinder devices to be coupled with the both cylinder devices.

4 Claims, 10 Drawing Sheets

TILT DEVICE FOR MARINE PROPULSION UNIT

BACKGROUND OF THE INVENTION

1. Field of the Invention

The present invention relates to a tilt device for a marine propulsion unit.

2. Description of the Related Art

Conventionally, as disclosed in Japanese Utility Model Application Publication (JP-B) No. 7-36879, a stem drive type marine propulsion unit (inboard/outboard motor) includes a cylinder device interposed between a boat body bracket and a marine propelling unit. This is tiltably supported with respect to the boat body bracket and a hydraulic fluid supply/discharge unit for extending and contracting the cylinder device. The tilt operating the marine propelling unit by supplying and discharging the hydraulic fluid from the hydraulic fluid supply/discharge unit to the cylinder device.

In the conventional art, while the right and left cylinder devices are interposed between the marine propelling unit and the boat body bracket, the hydraulic fluid supply/discharge unit is mounted in the inside of the boat body. Pipe fittings extended from the hydraulic fluid supply/discharge unit are elongated on the periphery of the marine propelling unit to be connected to the right and left cylinder devices.

However, the conventional art involves the following problems.

(1) Since the pipe fittings extended from the hydraulic fluid supply/discharge unit are elongated on the periphery of the marine propelling unit which is to be connected to the right and left cylinder devices, it is necessary to secure a space for a pipe fitting between the boat body and the marine propelling unit, so that the working efficiency for pipe fitting is not high.

(2) On the failure of a tilt device, it is necessary for the hydraulic fluid supply/discharge unit and/or the cylinder device to be replaced and it is necessary to insert/eject the pipe fitting, so that maintenance property is not good.

Further, the hydraulic fluid supply/discharge unit and the right and left cylinder devices may be integrated each other. However, when they are simply integrated, there is a difficulty with respect to disposing the right and left cylinder devices to the marine propelling unit having the common difference in the processing and the measure. On transportation of the tilt device, it is necessary to pack a large size component composed of an integrated combination of the hydraulic fluid supply/discharge unit and the right and left cylinder devices and transportation property is not excellent.

SUMMARY OF THE INVENTION

The object of the invention is to provide a tilt device having a pair of right and left cylinder devices and which will improve the working efficiency for pipe fitting from the hydraulic fluid supply/discharge unit to the right and left cylinder devices, the maintenance property, the processing property, the property to be disposed to the marine propelling unit and the transportation property in the tilt device.

The invention described provides a tilt device for a marine propulsion unit in which a cylinder device is interposed between a boat body side bracket and a marine propelling unit, which is tiltably supported with respect to the boat body side bracket, and a hydraulic fluid supply/discharge unit extends and contracts a cylinder device and tilt operates the marine propelling unit by supplying and discharging the hydraulic fluid from the hydraulic fluid supply/discharge unit to the cylinder device. The tilt device comprises a pair of cylinder devices to be arranged at right and left of the marine propelling unit. A hydraulic fluid supply/discharge: unit, which is separately formed from one of both cylinder devices and arranged between the both cylinder devices to be coupled with the both cylinder devices.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

FIG. 6A is a sectional view along an A—A line;

FIG. 6B is a sectional view along a B—B line;

FIG. 6C is a sectional view along a C—C line;

FIG. 6D is a sectional view along a D—D line;

DESCRIPTION OF THE PREFERRED EMBODIMENTS

Figure 1A:
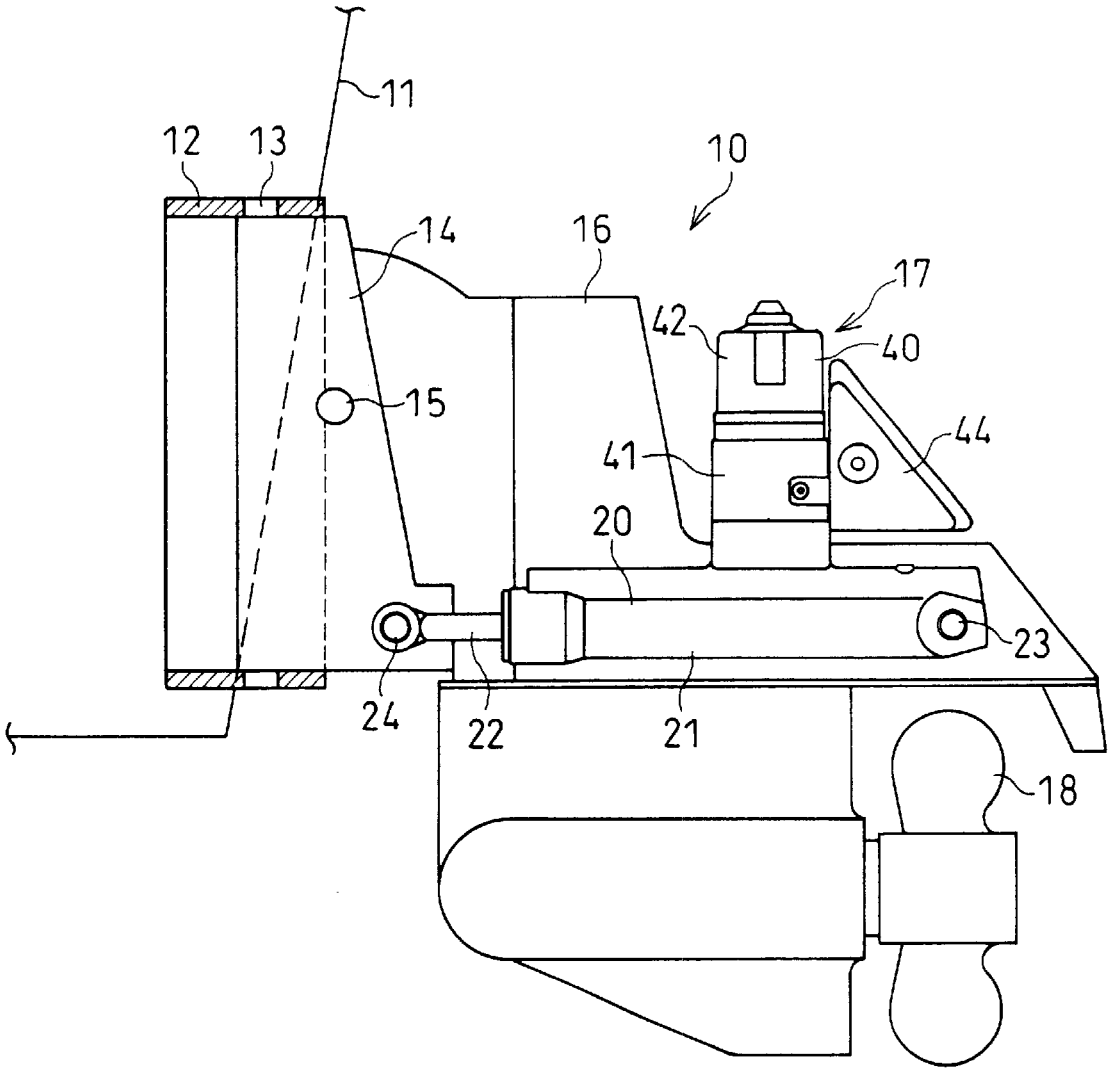
FIG. 1 is a schematic view of a marine propulsion unit.
Figure 1B:
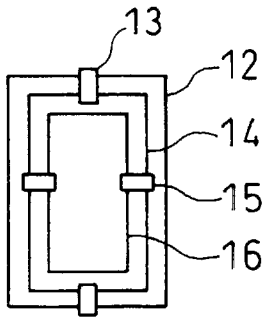

FIG. 1 shows a stern drive type marine propulsion unit (inboard/outboard motor) 10. In a marine propulsion unit 10, a joint bracket 14 is helm-rotatably supported to the both sides of a vertical helm-rotational axis 13. It is supported to an upper side and a lower side of a frame supporting portion of a clamp bracket 12, which is secured on a boat body 11. Further, in the marine propulsion unit 10, a marine propelling unit 16 is tiltably supported by a tilt device 17 to a horizontal tilt axis 15, which is supported on both sides of the frame supporting portion of the joint bracket 14. The joint bracket 14 composes a boat body bracket of the present invention.

Output of an engine (not illustrated) arranged in the inside of the boat body is transmitted to the marine propelling unit 16 via a transmitting axis (not illustrated), so that a propeller 18 can be driven.

In the tilt device 17, a pair of right and left cylinder devices 20 and 30 are mounted on both sides of the marine propelling unit 16 and respective cylinder devices 20 and 30 are interposed between the joint bracket 14 and the marine propelling unit 16. The hydraulic fluid is supplied and discharged from a hydraulic fluid supply/discharge unit 40 to the cylinder devices 20 and 30 to expand and contract cylinder devices 20 and 30. Therefore, the marine propelling unit 16 becomes tilt operable.

Figure 2:
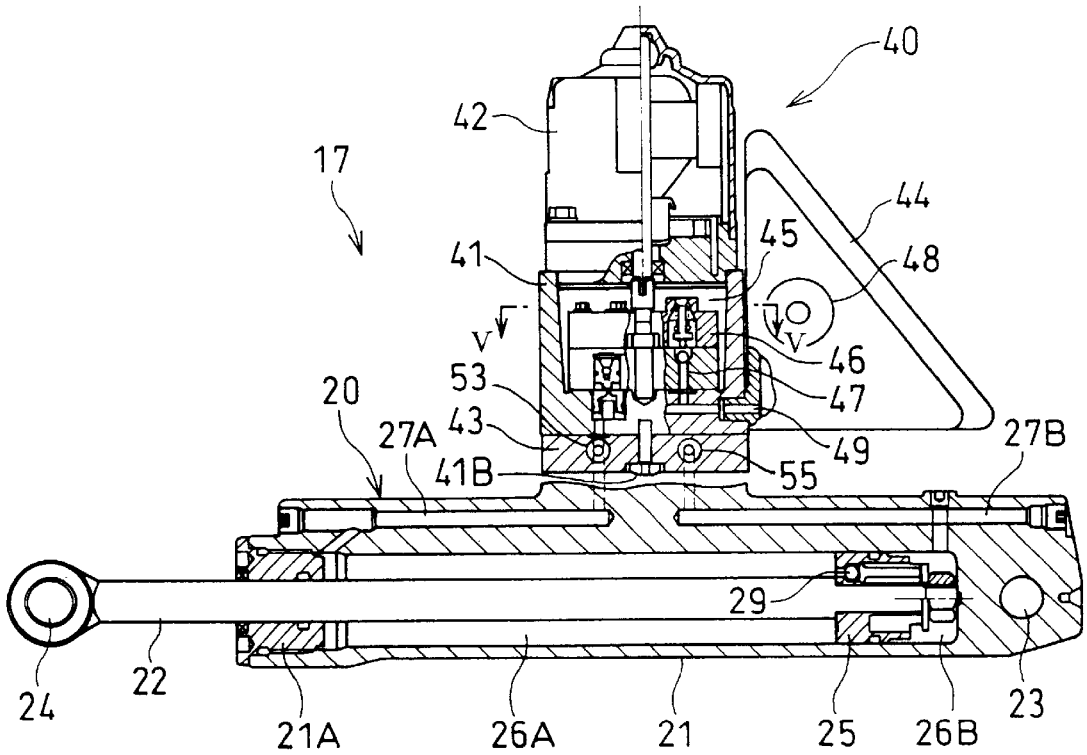
FIG. 2 is a fractured sectional view of main parts of a tilt device.
Figure 3:
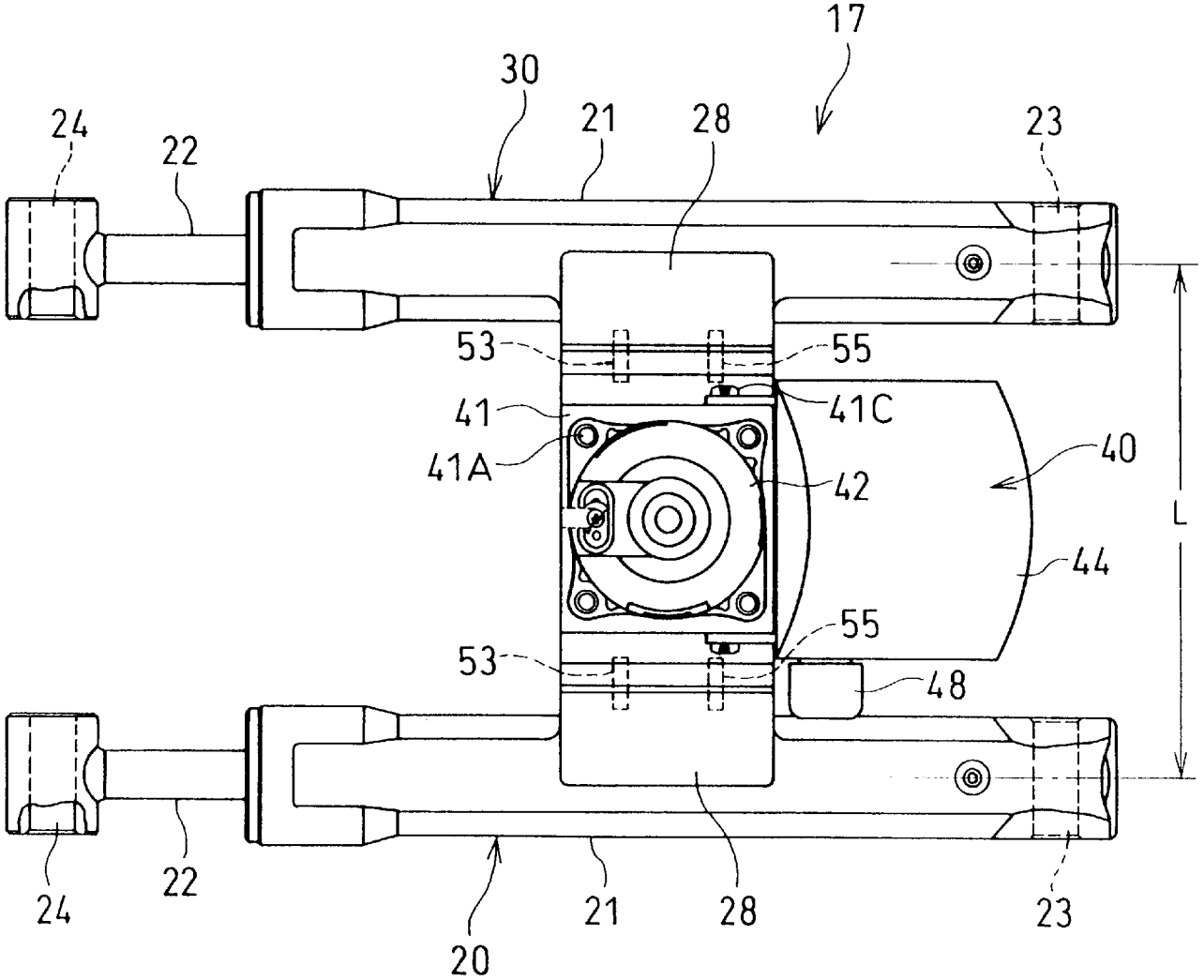
FIG. 3 is a plain view of FIG. 2.
Figure 4:
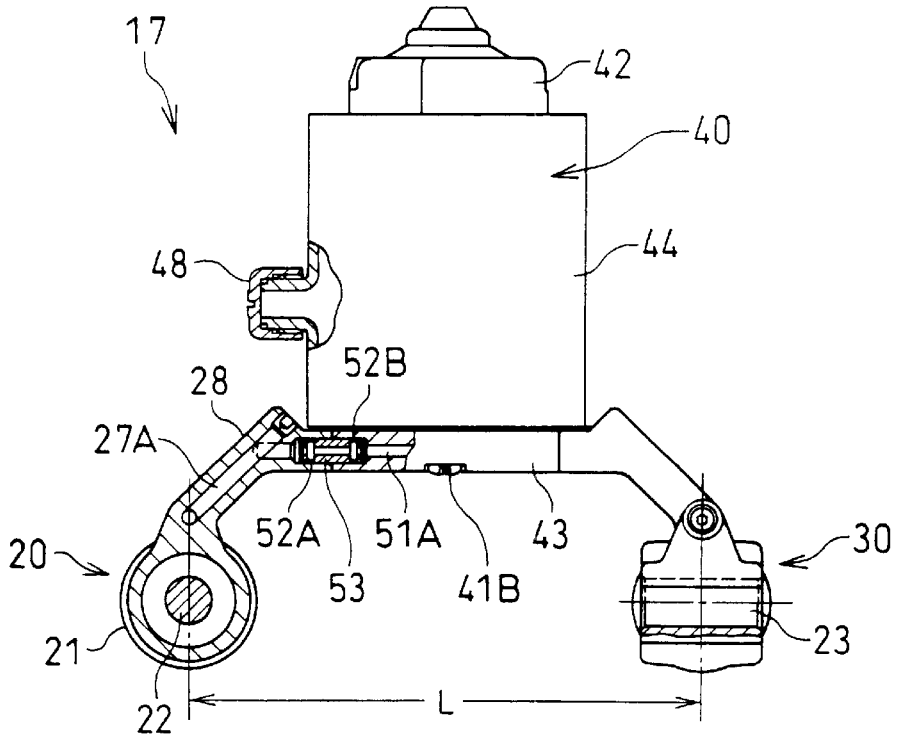
FIG. 4 is a front view of FIG. 2.
Figure 5:
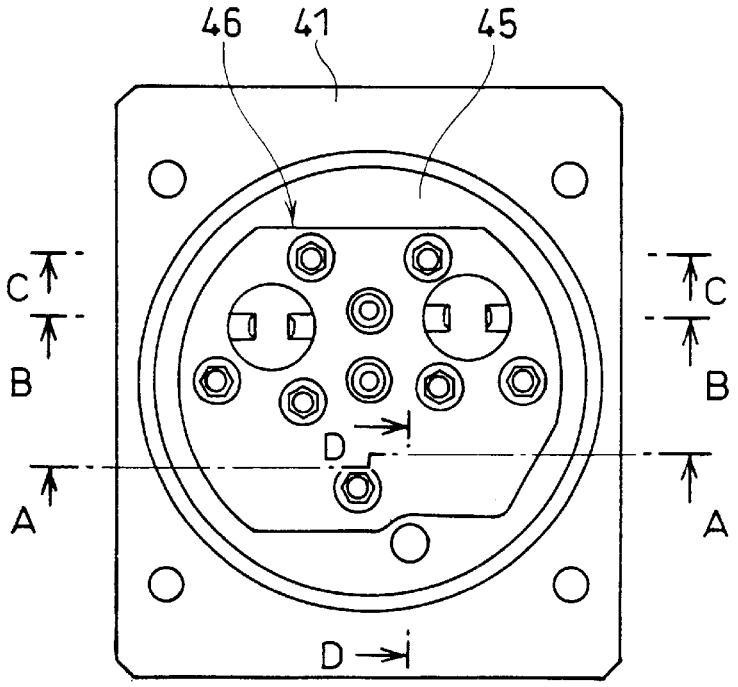
FIG. 5 is an arrow view along a V—V line of FIG. 2.
Figure 6A:
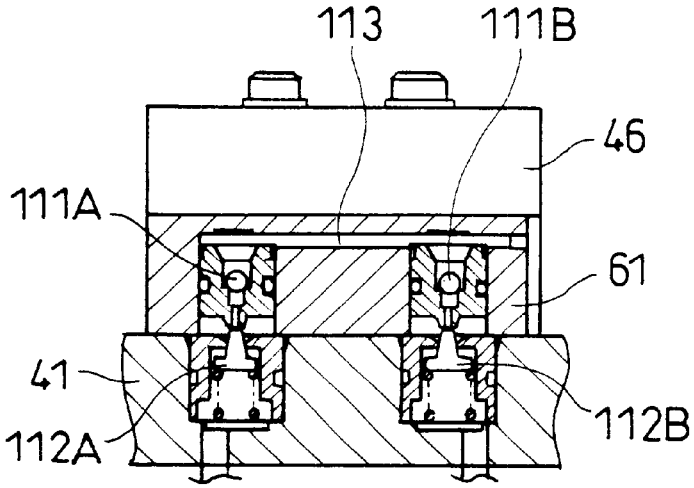
FIGS. 6A to 6D are sectional views of respective portions of FIG. 5.
Figure 6B:
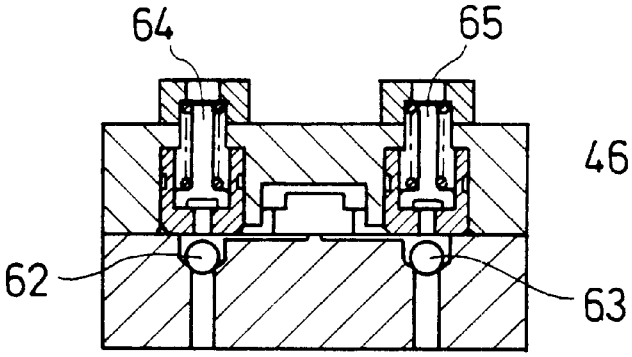
Figure 6C:
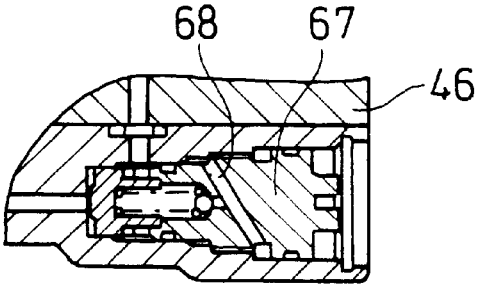
Figure 6D:
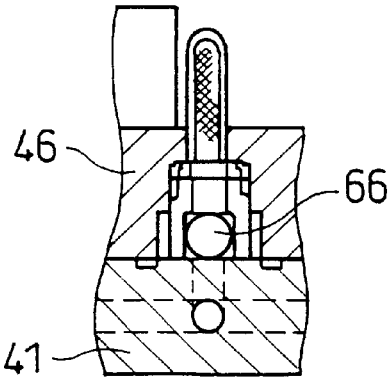
Figure 7:
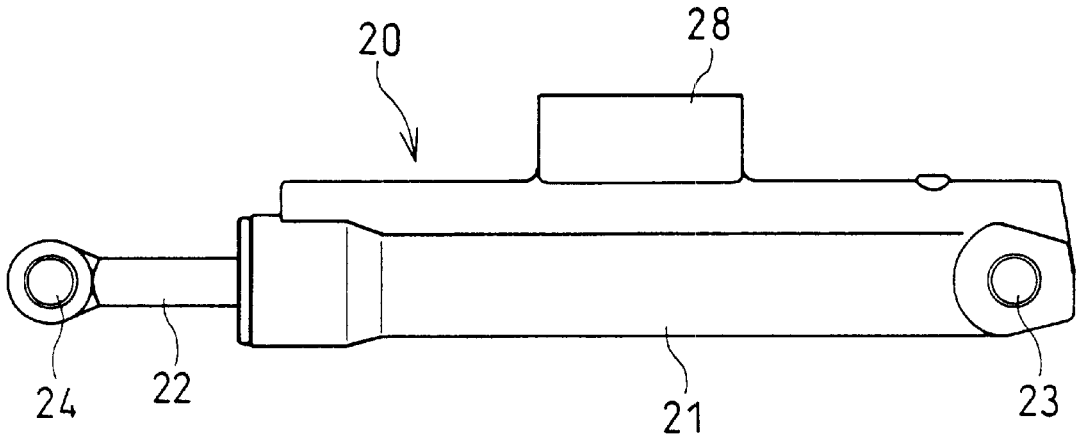
FIG. 7 is a sectional view showing a cylinder device itself.

As shown in FIGS. 2 through 4, the tilt device 17 is obtained such that the cylinder device 20, the cylinder device 30 and the hydraulic fluid supply/discharge unit 40 are separately formed to be coupled each other into an integrated body. In other words, the cylinder device 20 and the cylinder device 30 are located on the right and left side of the marine propelling unit 16. The hydraulic fluid supply/discharge unit 40 is formed separately from the cylinder device 20 and the cylinder device 30 to be mounted between the cylinder device 20 and the cylinder device 30 and connected to these cylinders 20 and 30. In this arrangement, respective cylinder devices 20 and 30 and the hydraulic fluid supply/discharge unit 40 are connected by joint pipes 53 and 55. Hydraulic fluid supply/discharge passages 53A and 55A are equipped on the joint pipes 53 and 55.

As shown in FIGS. 2 through 4 and FIG. 7, the cylinder device 20 (since the cylinder device 30 is symmetric with respect to the cylinder device 20, identical portions of the cylinder device 20 are represented by identical reference numerals and an explanation thereof is omitted) has a cylinder 21 made of aluminum alloy casting and a piston rod 22 to be inserted in the cylinder 21. The cylinder 21 is provided with a disposing portion 23 which is to be pin connected to a casing side of the marine propelling unit 16. The piston rod 22 is provided with a disposing portion 24 which is to be pin connected to the joint bracket 14. The piston rod 22 is provided with a piston 25 at an end to be inserted into the inside of the cylinder 21. Further, the piston rod 22 defines in the inside of the cylinder 21 a first tilt chamber 26A which accommodates the piston rod 22 and a second tilt chamber 26B which does not accommodate the piston rod 22. The cylinder 21 includes a first oil passage 27A communicating to the first tilt chamber 26A and a second oil passage 27B communicating to the second tilt chamber 26B in an upper portion thereof. In this arrangement, the cylinder device 20 is provided with a joint portion 28 having a droop plate shape, which extends from the upper middle portion of the cylinder 21 to diagonally to the upper and further extends in the horizontal direction. The first oil passage 27A and the second oil passage 27B are elongated in the joint portion 28 and end ports of these two oil passages 27A and 27B are opened to the joint surface of the joint portion 28.

Further, the cylinder device 20 is provided with a rod guide 21A for supporting the piston rod 22 slidably in the opening of the cylinder 21 and is provided with an absorber valve 29 in the piston 25. The absorber valve 29 is opened upon collision with driftwood or the like at a predetermined pressure to transport the oil of the first tilt chamber 26A to the second tilt chamber 26B. Therefore, the piston rod 22 becomes extendable.

As shown in FIG. 2 through FIG. 6D, the hydraulic fluid supply/discharge unit 40 has an outer appearance which comprising a tank housing 41 made of aluminum alloy casting, a reversible motor 42 secured on the upper portion of the tank housing 41 by a bolt 41A, a pipe fitting plate 43 made of aluminum alloy casting secured on the lower portion of the tank housing 41 by a bolt 41B and a reservoir tank 44 made of a resin connected to the tank housing 41 by a bolt 41C. In the hydraulic fluid supply/discharge unit 40, a reversible gear pump 46 is soaked and arranged in the tank 45 defined in the inside of the tank housing 41 and an output axis of the motor 42 is connected to a moved axis of the pump 46. It is possible to supply and discharge the oil from a flow passage 47 with a switching valve to the first tilt chamber 26A and the second tilt chamber 26B of the cylinder devices 20 and 30 through the first oil passage 27A and the second oil passage 27B of the cylinder devices 20 and 30. Here, the oil is pressure fed by the pump 46, which is driven by the motor 42. The flow passage 47 with a switching valve is internally stored and defined in the pump 46, the tank housing 41 and the pipe fitting plate 43. The reservoir tank 44 is provided with a feeding oil orifice cap 48 and is communicated to the tank 45 through an oil passage 49.

In this arrangement, the hydraulic fluid supply/discharge unit 40 defines a first connecting tube passage 51A and a second connecting tube passage 51B on the pipe fitting plate 43. The first connecting tube passage 51A and the second connecting tube passage 51B compose the flowing passage 47 with a switching valve. One set of end ports of the first connecting tube passage 51A and the second connecting tube passage 51B are opened, respectively on the right and left joint surfaces of the pipe fitting plate 43.

In the tilt device 17, the joint surface of the joint portion 28 of the cylinder device 20 is brought in contact with the left joint surface of the pipe fitting plate 43 of the hydraulic fluid supply/discharge unit 40. The end port of the first oil passage 27A of the cylinder device 20 and the end port of the first connecting tube passage 51A of the hydraulic fluid supply/discharge unit 40 are connected by the joint pipe 5. The joint pipe is located in the horizontal direction and fits in liquid tight manner in the end port of the first oil passage 27A and the end port of the first connecting tube passage 51A via O rings 52A and 52B. Further, the end port of the second oil passage 27B of the cylinder device 20 and the end port of the second connecting tube passage 51B of the hydraulic fluid supply/discharge unit 40 are connected by the joint pipe 55. This joint pipe is located in the horizontal direction and fits in liquid tight manner in the end port of the second oil passage 27B and the end port of the second connecting tube passage 51B via O rings 54A and 54B (not illustrated). As a result, the hydraulic fluid supply/discharge unit 40 and the cylinder device 20 are integrally composed. The hydraulic fluid supply/discharge passages 53A and 55A are equipped on the joint pipes 53 and 55. At the same time, the joint surface of the joint portion 28 of the cylinder device 30 is brought in contact with the right joint surface of the pipe fitting plate 43 of the hydraulic fluid supply/discharge unit 40. The end port of the first oil passage 27A of the cylinder device 30 and the end port of the first connecting tube passage 51A of the hydraulic fluid supply/discharge unit 40 are connected by the joint pipe 53. This joint pipe fits in liquid tight manner in the end port of the first oil passage 27A and the end port of the first connecting tube passage 51A via O rings 52A and 52B. Further, the end port of the second oil passage 27B of the cylinder device 30 and the end port of the second connecting tube passage 51B of the hydraulic fluid supply/discharge unit 40 are connected by the joint pipe 55. The joint pipe 55 fits tightly to seal the end port of the second oil passage 27B and the end port of the second connecting tube passage 51B via O rings 54A and 54B (not illustrated). As a result, the hydraulic fluid supply/discharge unit 40 and the cylinder device 30 are integrally composed. The hydraulic fluid supply/discharge passages 53A and 55A are equipped on the joint pipes 53 and 55.

Further, in the tilt device 17, the joint portions 28 of the cylinder device 20 and the cylinder device 30 respectively. They are connected to the right side and the left side of the pipe fitting plate 43 of the hydraulic fluid supply/discharge unit 40 only by above described fitting of the joint pipes 53 and 55. The fitting is composed such that the hydraulic fluid supply/discharge unit 40 is interposed between both cylinder devices 20 and 30. The devices can be maintained by the pin connection of respective disposing portions 23 and 24 of the cylinder device 20 and the cylinder device 30 with the marine propelling unit 16 and the joint bracket 14 on the both sides of the marine propelling unit 16.

Figure 8:
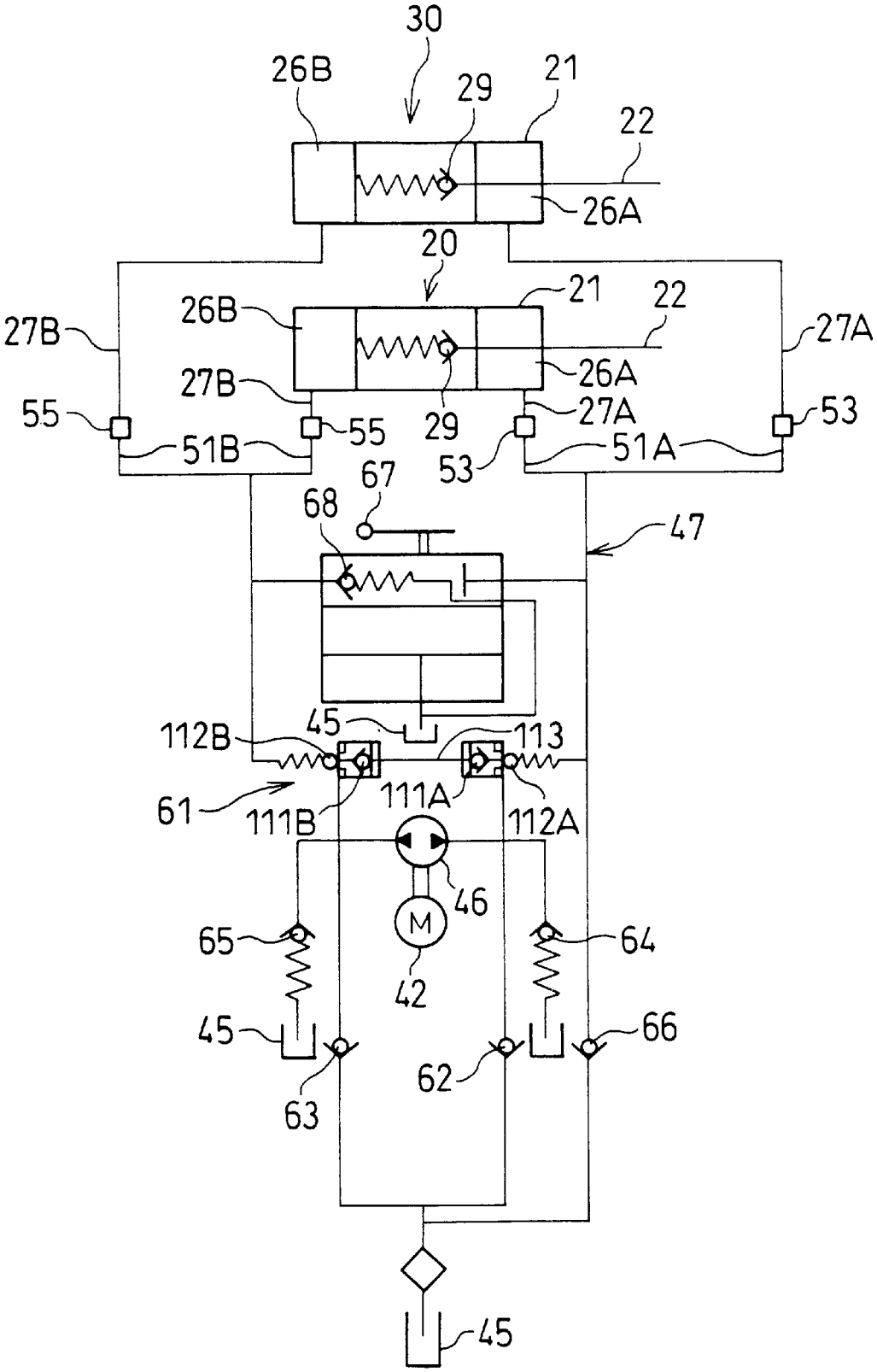
FIG. 8 is a hydraulic circuit of a tilt device.

The hydraulic fluid supply/discharge unit 40 include an oil passage 47 having a switch valve which is connected the pump 46 to the first oil passage 27A and the second oil passage 27B. It comprises a shuttle type switch valve 61, check valves 62 and 63, a down-blow valve 64, an up-blow valve 65, a filter valve 66, a manual valve 67, and a thermal-blow valve 68 as shown in FIG. 8.

The shuttle type switch valve 61 includes a first check valve 112A and a second check valve 112B located at opposite sides of a first spool 111A having a check mechanism and a second spool 111B having a check mechanism. The spools 111A and 111B are connected through a passage 113. When the pump 46 is rotated in a normal direction, the first check valve 112A is opened by the oil feeding pressure. The oil feeding pressure passing through the first spool 111A having the check mechanism moves the second spool 111B having the check mechanism to open the second check valve 112B which is located at the opposite side. When the rotation of the pump 46 is reversed, the second check valve 112B is opened by the oil feeding pressure. The oil feeding pressure passing through the second spool 111B having the check mechanism moves the first spool 111A having the check mechanism to open the first check valve 112A which is located at the opposite side.

The check valve 62 is interposed between the pump 46 and the tank 45. When the cylinder devices 20 and 30 are operated to tilt up, the volume in the cylinder 21 is increased by an amount of the piston rod 22 retreated and an amount of hydraulic fluid compensated is reduced. Then, the shortage of circulating oil is compensated for from the tank 45 to the pump 46 by the opening operation of the check valve 62.

The check valve 63 is interposed between the pump 46 and the tank 45. When the tilt down of the cylinder devices 20 and 30 are completed and return oil from the second tilt chamber 26B to the pump 46 has run out, and the pump 46 is further operated, the hydraulic fluid can be supplied from the tank 45 to the pump 46 by the opening operation of the check valve 63.

During tilt down operation of the cylinder devices 20 and 30, when the volume of the cylinder 21 is reduced by a volume of the inserted piston rod 22, and circulating oil of the hydraulic fluid remains, the down-blow valve 64 returns the remaining hydraulic fluid to the tank 45.

Furthermore, during tilt up operation of the cylinder device 20 and 30, when the pump 46 is further operated even if the piston 25 is abutted against the rod guide 21A, the up-blow valve 65 exhibits an up-blow function which returns the excessive hydraulic fluid into the tank 45.

In filter valve 66, when the absorber valve 29 is opened by collision of driftwood or the like against the marine propelling unit 16 and it is tipped up, the volume in the cylinder 21 is increased by an amount that the piston rod 22 has retreated. Accordingly, the pressure of the cylinder 21 is reduced. Then, the negative pressure of the cylinder 21 is compensated from the tank 45 by the opening operation of the filter valve 66 and absorption into the first tilt chamber 26A.

When the tilt device 17 is out of order, the manual valve 67 can be manually operated, the cylinder devices 20 and 30 are manually contracted, and the marine propelling unit 16 can be manually tilted down.

The thermal-blow valve exhibits a thermal-blow function which releases the increased hydraulic fluid into the tank 45 when the hydraulic fluid in the cylinder devices 20, 30 are increased due to a temperature change or the like.

The basic operation of the tilt device 20 will be explained below.

(1) Tilt down

When the motor 42 and the pump 46 are normally rotated, the discharge oil from the pump 46 opens the first check valve 112A of the shuttle type switch valve 61, and also opens the second check valve 112B through the spools 111A and 111B. With this operation, the discharged oil from the pump 46 passes through the first check valve 112A and the first oil passage 27A and is supplied into the first tilt chamber 26A of the cylinder devices 20, 30. The hydraulic fluid in the second tilt chamber 26B of the cylinder devices 20 and 30 passes through the second oil passage 27B and the second check valve 112B and returns to the pump 46 to contract the cylinder devices 20 and 30 so that the cylinder device 21 is tilted down.

(2) Tilt up

When the motor 42 and the pump 46 are rotated in reverse, the discharged ail from the pump 46 opens the second check valve 112B of the shuttle type switch valve 61, and also opens the first check valve 112A through the spools 111A and 111B. With this operation, the discharged oil from the pump 46 passes through the second check valve 112B and the second oil passage 27B. It is then supplied to the second tilt chamber 26B of the cylinder devices 20 and 30. The hydraulic fluid in the first tilt chamber 26A of the cylinder devices 20, 30 passes through the first oil passage 27A and the first check valve 112A and return to the pump 46 to expand the cylinder devices 20 and 30. Thus, the cylinder devices 20, 30 are tilted up.

Accordingly, the present embodiment has following effects.

(1) The hydraulic fluid supply/discharge unit 40 is coupled with the cylinder devices 20 and 30 to be integrally composed. Hence, there is no need to secure a pipe fitting space between the boat body 11 and the marine propelling unit 16, so that the working efficiency for pipe fitting is high and the appearance is good.

(2) On the failure of a tilt device 17, it is enough that the hydraulic fluid supply/discharge unit 40 and/or the cylinder devices 20 and 30 are replaced and it is not necessary to insert/eject the pipe fitting, so that maintenance property is good.

(3) The hydraulic fluid supply/discharge unit 40, the cylinder device 20 and the cylinder device 30 are divided and separately formed to be coupled with each other into an integrated body. Thus the processing property is improved and disposing property from the valves to the hydraulic fluid supply/discharge unit 40 is also improved.

(4) The cylinder device 20, the cylinder device 30 and the hydraulic fluid supply/discharge unit 40 are separately formed to be coupled with each other into an integrated body. Upon disposing the right and left cylinder devices 20 and 30 to the marine propelling unit 16, with respect to the common difference in measure of the marine propelling unit 16, it is possible to correct the disposing position (disposing interval L or the like) of the right and left cylinder devices 20 and 30, so that no forced power is effected to the cylinder devices 20 and 30 after disposing them and operation thereof becomes smooth.

(5) Upon transporting the tilt device 17, it is possible to separate and pack the hydraulic fluid supply/discharge unit 40, the right cylinder device 20 and the left cylinder device 30, so that transporting property is improved.

(6) The hydraulic fluid supply/discharge passages between the hydraulic fluid supply/discharge unit 40 and the both cylinder devices 20 and 30 can configure only by the joint pipes 53 and 55 for coupling them. Therefore, the working efficiency for pipe fitting can be improved.

(7) The relative position of the both cylinder devices 20 and 30 can be simply adjusted merely by adjusting the coupling state of the joint pipes 53 and 55 with respect to the hydraulic fluid supply/discharge unit 40. The position of the right and left cylinder devices 20 and 30 with respect to common difference in measure of the marine propelling unit 16 also can be simply corrected.

Figure 9A:
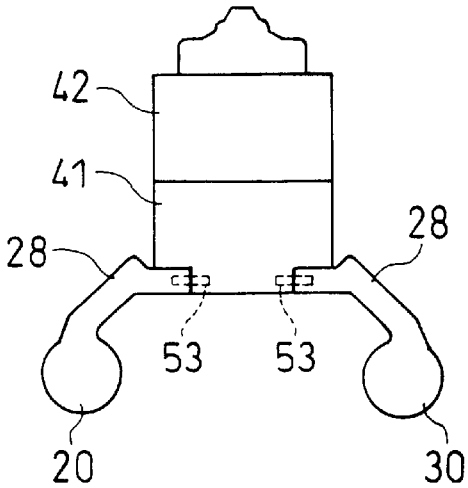
FIGS. 9A to 9E are schematic views of a modification of a tilt device.

FIG. 9A shows a modification of the tilt device 17. This modification is obtained from an integrated combination of a portion of the pipe fitting plate 43 and the tank housing 41 in the hydraulic fluid supply/discharge unit 40.

Figure 9B:
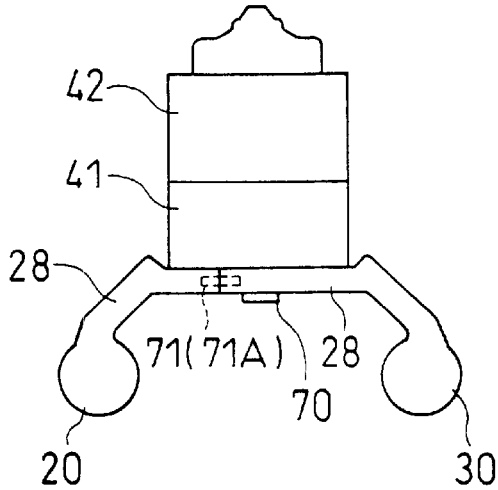

FIG. 9B also shows a modification of the tilt device 17. The tank housing 41 of the hydraulic fluid supply/discharge unit 40 is secured to the joint portion 28 of one cylinder device 30 of the both cylinder devices 20 and 30 by the bolt 70. The joint portions 28 of the both cylinder devices 20 and 30 are coupled with each other by the joint pipes 71 and 72, which are disposed horizontally. The hydraulic fluid supply/discharge passages 71A and 72A are arranged in these joint pipes 71 and 72. The first tilt chamber 26A and the second tilt chamber 26B of the cylinder devices 20 and 30 are connected to the first connecting tube passage 51A and the second connecting tube passage 51B via the hydraulic fluid supply/discharge passages 71A and 72A of the joint pipes 71 and 72. The first connecting tube passage 51A and the second connecting tube passage 51B compose the flowing passage 47 with a switching valve of the hydraulic fluid supply/discharge unit 40. In this arrangement, the disposed portion of the bolt 70, which is disposed on the joint portion 28 of the cylinder device 30, comprises a long hole so that the relative disposing position (disposing interval L) of the both cylinder devices 20 and 30 can be adjusted.

Accordingly, the present modification has the following effects.

(1) The hydraulic fluid supply/discharge passages between the hydraulic fluid supply/discharge unit 40 and the both cylinder devices 20 and 30 can be configured only by securing the hydraulic fluid supply/discharge unit 40 and one cylinder devices 30 and coupling both cylinder devices 20 and 30 with the joint pipes 71 and 72. Therefore, the working efficiency for pipe fitting can be improved.

(2) The relative position of [the] both cylinder devices 20 and 30 can be simply adjusted by merely adjusting the coupling state of the joint pipes 71 and 72 between both cylinder devices 20 and 30 and the disposed position of the right and left cylinder devices 20 and 30 with respect to common difference in measure of the marine propelling unit 16 also can be simply corrected.

Figure 9C:
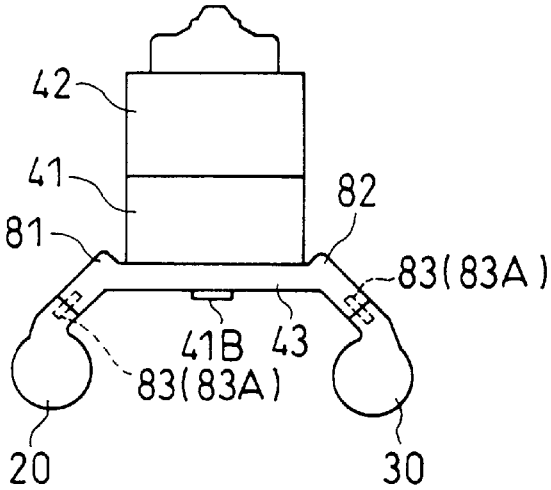

FIG. 9C also shows a modification of the tilt device 17. Leg portions 81 and 82, which are elongated to the opposite sides of the marine propelling unit 16, are equipped to the pipe fitting plate 43 to be secured on the tank housing 41 of the hydraulic fluid supply/discharge unit 40. The cylinders 21 of the cylinder devices 20 and 30 are coupled with both leg portions 81 and 82 by the joint pipes 83 and 84, which are located at an angle. Hydraulic fluid supply/discharge passages 83A and 84A are defined in these joint pipes 83 and 84.

Figure 9D:
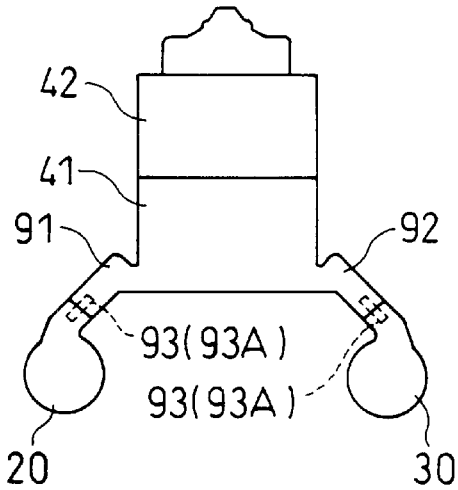

FIG. 9D also shows a modification of the tilt device 17. Leg portions 91 and 92, which are elongated to the opposite sides of the marine propelling unit 16, are equipped to the tank housing 41 of the hydraulic fluid supply/discharge unit 40. The cylinders 21 of the cylinder devices 20 and 30 are coupled to [the] both leg portions 91 and 92 by the joint pipes 93 and 94, which are located at an angle. Hydraulic fluid supply/discharge passages 93A and 94A are defined in these joint pipes 93 and 94.

Figure 9E:
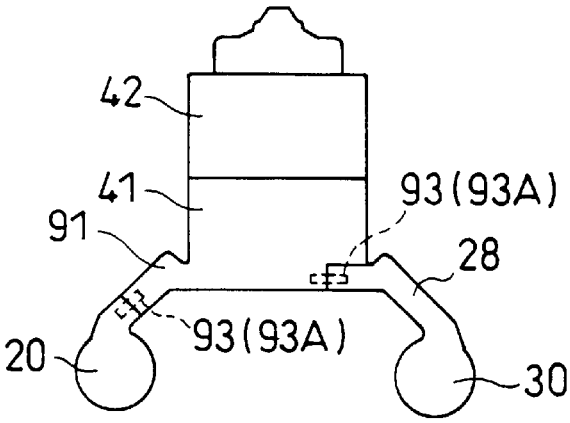

FIG. 9E also shows a modification of the tilt device 17. Leg portion 91 is equipped to one side of the tank housing 41 of the hydraulic fluid supply/discharge unit 40. The cylinder 21 of the cylinder device 20 is coupled to the leg portion 91 by the joint pipes 93 and 94, which are located at an angle. The cylinder 21 of the cylinder device 30 is coupled to the other side of the tank housing 41 of the hydraulic fluid supply/discharge unit 40 by the joint pipes 93 and 94, which are located in horizontal direction.

Further, in the modifications of the tilt device 17 in FIGS. 9C through 9E, the cylinders 21 of the cylinder devices 20 and 30 are coupled to the tank housing 41 by the joint pipes 83, 84, 93 and 94. They are located at an angle, so that the disposing positions of the cylinder devices 20 and 30 can be corrected not only in the width direction of the marine propelling unit 16, but also in upper and lower directions of the marine propelling unit 16.

Figure 10:
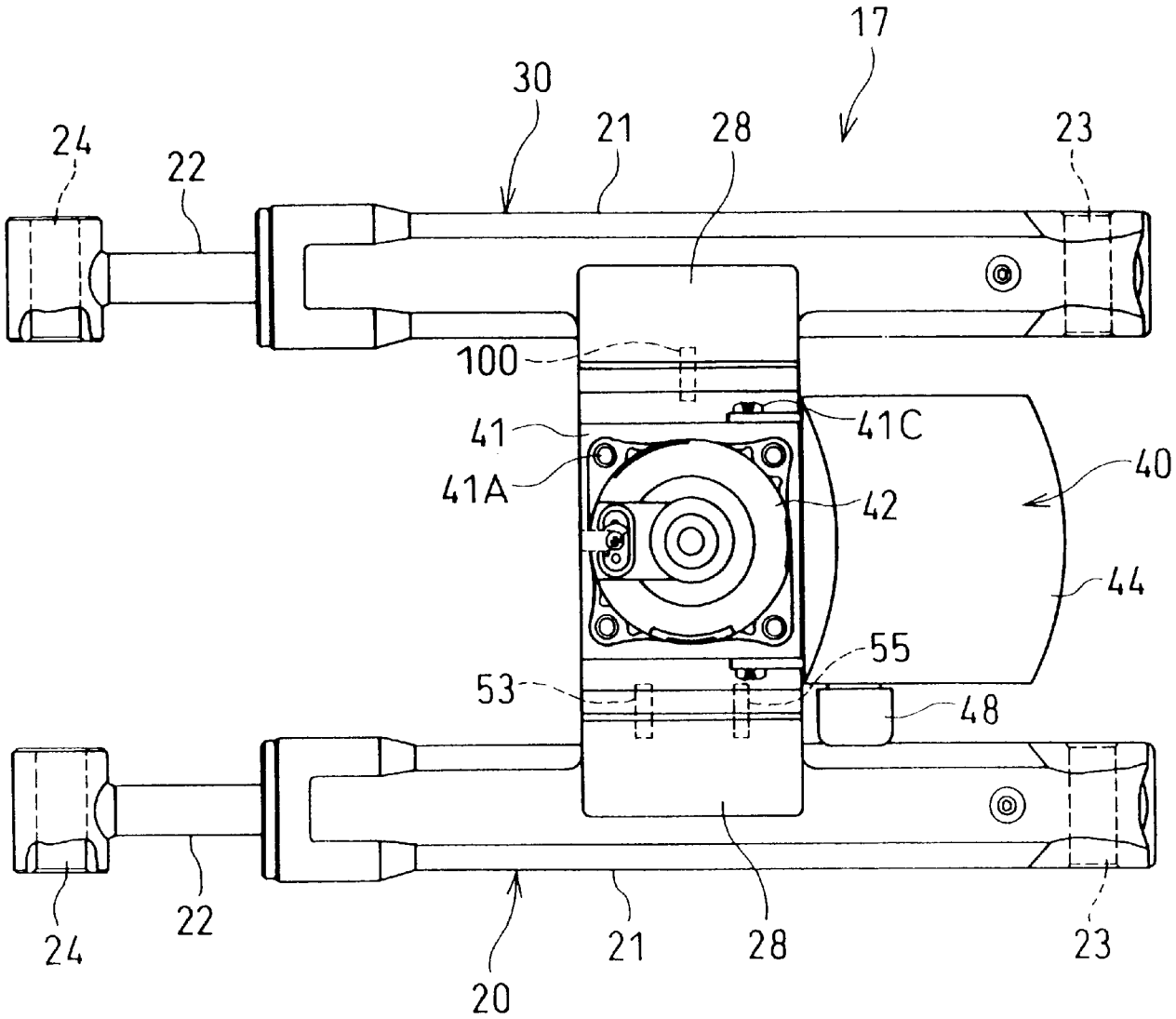
FIG. 10 is a plain view of another modification of a tilt device.
Figure 11A:
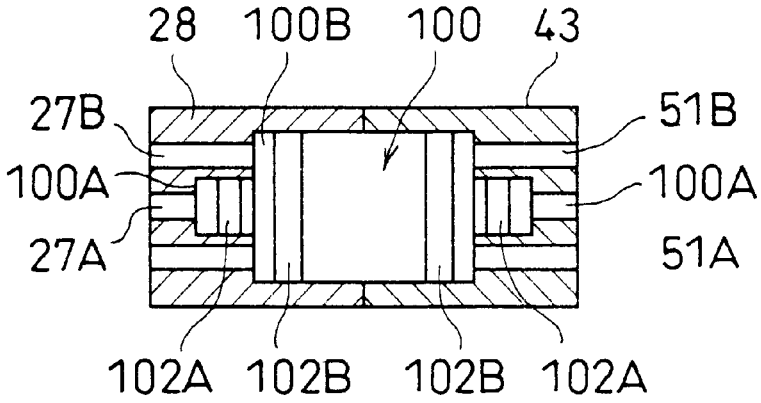
FIGS. 11A and 11B are sectional views of main parts of FIG. 10.
Figure 11B:
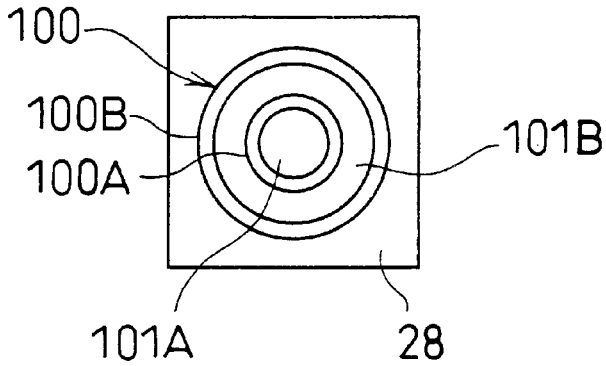
Figure 12:
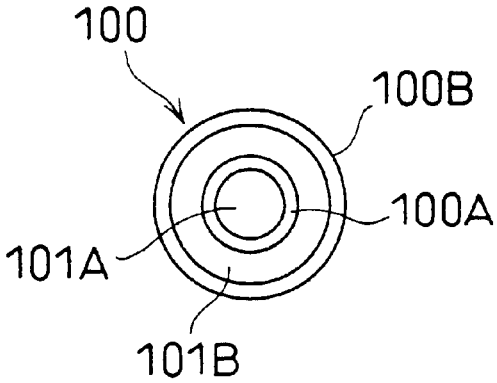
FIG. 12 is an end face view showing a joint pipe.

FIG. 10 shows another modification of the tilt device 17. A joint pipe 100 is mounted on a single axis against the cylinder device 30 to couple the joint portion 28 arranged in the cylinder 21 of one cylinder device 30 with the pipe fitting plate 43 secured in the tank housing 41 of the hydraulic fluid supply/discharge unit 40. As shown in FIGS. 11A, 11B and 12, the joint pipe 100 is composed of a double tube including a small diameter tube 100A and a large diameter tube 100B on the same axis. An inner diameter of the small diameter tube 100A comprises a hydraulic fluid supply/discharge passage 101A and an annular space between the small diameter tube 100A. The large diameter tube 100B comprises a hydraulic fluid supply/discharge passage 101B, so that hydraulic fluid supply/discharge passages 101A and 101B are defined to be independent each other. The opposite ends of the small diameter tube 100A are fitted into the end port of the first oil passage 27A provided in the joint portion 28 and the end port of the first connecting tube passage 51A provided in the pipe fitting plate 43 via an O ring 102A in liquid tight manner. Further, the opposite ends of the large diameter tube 100B are fitted into the end port of the second oil passage 27B provided in the joint portion 28 and the end port of the second connecting tube passage 51B provided in the pipe fitting plate 43 via an O ring 102B in liquid tight manner. According to this modification, since the joint pipe 100 to be coupled with the cylinder device 30 is mounted on the single axis against the cylinder device 30, the cylinder device 30 is able to rotate around the joint pipe 100 as a rotational axis to swing and adjust the disposing position of the cylinder device 30. Thus, the disposing positions of the cylinder devices 20 and 30 against the common difference in measure of the marine propelling unit 16 can be easily corrected As heretofore explained, embodiments of the present invention have been described in detail with reference to the drawings. However, the specific configurations of the present invention are not limited to the embodiments but those having a modification of the design within the range of the present invention are also included in the present invention. For example, the tilt device of the present invention may be configured such that a pair of cylinder devices and a hydraulic fluid supply/discharge unit are separately formed, respectively to be coupled each other into an integrated body and a number to divide them is not limited.

As described above, according to the present invention, in a tilt device having a pair of right and left cylinder devices, the working efficiency for pipe fitting from the hydraulic fluid supply/discharge unit to the right and left cylinder devices, the maintenance property, the processing property, the property to be disposed to the marine propelling unit and the transportation property in the tilt device are improved.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A tilt device for a marine propulsion unit comprising a pair of cylinder devices disposed respectively at a right and a left side of the marine propulsion unit, a fluid supply/discharge unit disposed between the cylinder devices, the fluid supply/discharge unit being in fluid connection with both cylinder devices, a joint pipe defining a fluid passage between the cylinder devices and the fluid supply/discharge unit, the joint pipe comprising a double tube having a small diameter tube completely within a larger diameter tube, an inner diameter of the small diameter tube defining a first fluid supply/discharge passage, and an annular space between the small diameter tube and the large diameter tube defining a second fluid supply/discharge passage.

2. A tilt device according to claim 1, wherein said joint pipe is mountable on a single axis against the cylinder device.

3. A tilt device for a marine propulsion unit wherein a cylinder device is interposed between a boat body side bracket and a marine propelling unit, which is tiltably supported with respect to the boat body side bracket; and a hydraulic fluid supply/discharge unit arranged and constructed to extend and contract a cylinder device and tilt operate said marine propelling unit by supplying and discharging the hydraulic fluid from the hydraulic fluid supply/discharge unit to the cylinder device comprising, a pair of cylinder devices to be arranged at right and left sides of said marine propelling unit, a hydraulic fluid supply/discharge unit, which is separately formed from respective one of both cylinder devices and arranged between the both cylinder devices to be coupled with both cylinder devices, said respective one of said both cylinder devices are coupled with said hydraulic fluid supply/discharge unit by a joint pipe to define a hydraulic fluid supply/discharge passage in said joint pipe, said joint pipe to be coupled to said cylinder device is mounted on a single axis against said cylinder device, and said joint pipe is composed of a double tube including a small diameter tube and a large diameter tube on the same axis, the inner diameter of said small diameter tube having one hydraulic fluid supply/discharge passage and an annular space between said small diameter tube and said large diameter tube having other hydraulic fluid supply/discharge passage.

4. A tilt device for a marine propulsion unit wherein a cylinder device is interposed between a boat body side bracket and a marine propelling unit, which is tiltably supported with respect to the boat body side bracket; and a hydraulic fluid supply/discharge unit arranged and constructed to extend and contract a cylinder device and tilt operate said marine propelling unit by supplying and discharging the hydraulic fluid from the hydraulic fluid supply/discharge unit to the cylinder device comprising, a pair of cylinder devices to be arranged at right and left sides of said marine propelling unit, a hydraulic fluid supply/discharge unit, which is separately formed from respective one of both cylinder devices and arranged between the both cylinder devices to be coupled with both cylinder devices, said hydraulic fluid supply/discharge unit is secured to one of said both cylinder devices and said both cylinder devices are coupled with said joint pipe to each other to define a hydraulic fluid supply/discharge passage in said joint pipe, said joint pipe to be coupled to said cylinder device is mounted on a single axis against said cylinder device, and said joint pipe is composed of a double tube including a small diameter tube and a large diameter tube on the same axis, the inner diameter of said small diameter tube having one hydraulic fluid supply/discharge passage and an annular space between said small diameter tube and said large diameter tube having other hydraulic fluid supply/discharge passage.

* * * * *

UNITED STATES PATENT AND TRADEMARK OFFICE

CERTIFICATE OF CORRECTION

PATENT NO. : 6,454,619 B1
DATED : September 24, 2002
INVENTOR(S) : Yasuo Funami et al.

It is certified that error appears in the above-identified patent and that said Letters Patent is hereby corrected as shown below:

Title page, Item [54] and Column 1, line 1,
The title should read -- TILT DEVICE FOR AN INBOARD/OUTBOARD MOTOR --.

Signed and Sealed this

Seventeenth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,454,619 B1
DATED : September 24, 2002
INVENTOR(S) : Yasuo Funami et al.

It is certified that error appears in the above-identified patent and that said Letters Patent is hereby corrected as shown below:

Title page, Item [54] and Column 1, line 1,
Title, "TILT DEVICE FOR AN INBOARD/OUTBOARD MOTOR" (as issued in Certificate of Correction issued June 17, 2003) should be deleted and -- TILT DEVICE FOR MARINE PROPULSION UNIT -- is reinstated.

Signed and Sealed this

Sixth Day of December, 2005

JON W. DUDAS
*Director of the United States Patent and Trademark Office*